US011391186B2

(12) United States Patent
Contarin et al.

(10) Patent No.: US 11,391,186 B2
(45) **Date of Patent: *Jul. 19, 2022**

(54) VALVE TRAIN ASSEMBLY

(71) Applicant: Eaton Intelligent Power Limited, Dublin (IE)

(72) Inventors: Fabiano Contarin, Rivarolo Canavese (IT); Nicola Andrisani, Cumiana (IT); Eric Yankovic, Augusta, MI (US); Mark VanWingerden, Battle Creek, MI (US); Matthew Vance, Kalamazoo, MI (US); James E. McCarthy, Jr., Kalamazoo, MI (US); Michael Guzak, Battle Creek, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 17/141,277

(22) Filed: Jan. 5, 2021

(65) Prior Publication Data

US 2021/0180475 A1 Jun. 17, 2021

Related U.S. Application Data

(63) Continuation of application No. 16/209,222, filed on Dec. 4, 2018, now Pat. No. 10,907,514, which is a (Continued)

(51) Int. Cl.

| | |
|---|---|
| ***F01L 1/18*** | (2006.01) |
| ***F01L 13/06*** | (2006.01) |
| ***F01L 1/047*** | (2006.01) |

(52) U.S. Cl.

CPC ..... *F01L 1/182* (2013.01); *F01L 1/047* (2013.01)

(58) Field of Classification Search

CPC . F01L 1/181; F01L 1/182; F01L 1/047; F01L 1/2411; F01L 1/26; F01L 1/46; (Continued)

(56) References Cited

U.S. PATENT DOCUMENTS 5,626,116 A * 5/1997 Reedy ..... F01L 1/181 123/321
5,975,251 A 11/1999 McCarthy
(Continued)

FOREIGN PATENT DOCUMENTS

CN 103306767 A 9/2013
CN 103328778 A 9/2013
(Continued)

OTHER PUBLICATIONS

International Search Report and Written Opinion for International Application No. PCT/EP2017/065667 dated Oct. 30, 2017, 12 pages.
(Continued)

*Primary Examiner* — Devon C Kramer
*Assistant Examiner* — Kelsey L Stanek
(74) *Attorney, Agent, or Firm* — RMCK Law Group, PLC

(57) ABSTRACT

A valve train assembly includes at least a number of exhaust valves; at least one camshaft with at least a pair of a primary lift cam and an engine brake lift cam. A number of rocker arms each include a cam follower for following one of the primary lift cam and the engine brake lift cam. One rocker arm includes a cam follower following an engine brake lift cam. The rocker arm is provided with an engine brake capsule. Various biasing assemblies are disclosed that cooperate with one of the rocker arms of which the cam follower follows an engine brake lift cam to accommodate mechanical lash.

19 Claims, 16 Drawing Sheets

Related U.S. Application Data continuation of application No. PCT/EP2017/065667, filed on Jun. 26, 2017.

(60) Provisional application No. 62/405,397, filed on Oct. 7, 2016, provisional application No. 62/355,677, filed on Jun. 28, 2016, provisional application No. 62/354,707, filed on Jun. 25, 2016.

(58) Field of Classification Search
CPC . F01L 13/06; F01L 2760/003; F02D 13/0234; F02D 13/0249; F02D 13/04
USPC ..... 123/90.27, 90.39, 90.4, 90.44, 90.45, 123/90.46
See application file for complete search history.

(56) References Cited

U.S. PATENT DOCUMENTS

| | | | | |
|---|---|---|---|---|
| 6,000,374 | A | 12/1999 | Cosma et al. | |
| 7,712,449 | B1 | 5/2010 | Schwoerer | |
| 8,851,048 | B2 | 10/2014 | Meistrick | |
| 9,435,234 | B2 | 9/2016 | Yang | |
| 2003/0154941 | A1 | 8/2003 | Hendriksma | |
| 2003/0217715 | A1 | 11/2003 | Pierik | |
| 2008/0223325 | A1 | 9/2008 | Meistrick | |
| 2010/0108007 | A1 | 5/2010 | Meistrick et al. | |
| 2010/0139616 | A1 | 6/2010 | Mariano et al. | |
| 2011/0203549 | A1* | 8/2011 | Schnell | F01L 1/267 123/322 |
| 2013/0269653 | A1* | 10/2013 | Yang | F01L 1/20 123/323 |
| 2014/0020654 | A1* | 1/2014 | Yang | F01L 1/20 123/323 |
| 2014/0251266 | A1 | 9/2014 | Emmons et al. | |
| 2017/0030231 | A1 | 2/2017 | Jeon et al. | |
| 2021/0040871 | A1* | 2/2021 | Vanwingerden | F01L 13/06 |

FOREIGN PATENT DOCUMENTS

| | | | | |
|---|---|---|---|---|
| CN | 103597174 | A | 2/2014 | |
| CN | 104066938 | A | 9/2014 | |
| CN | 105089822 | A | 11/2015 | |
| CN | 107023342 | A | 8/2017 | |
| CN | 107143394 | A | 9/2017 | |
| EP | 1721069 | A1 | 11/2006 | |
| EP | 3073069 | A1 | 9/2016 | |
| JP | 2001289021 | A | 10/2001 | |
| WO | 2016118548 | A1 | 7/2016 | |
| WO | WO-2016118548 | A1 * | 7/2016 | F01L 1/181 |

OTHER PUBLICATIONS

Chinese Office Action for CN Application No. 201880087409.8 dated Oct. 27, 2021.

* cited by examiner

VALVE TRAIN ASSEMBLY

CROSS-REFERENCE TO RELATED APPLICATIONS

This application is a continuation of U.S. patent application Ser. No. 16/209,222 filed Dec. 4, 2018, which is a continuation of International Patent Application No. PCT/EP2017/065667 filed on Jun. 26, 2017, which claims the benefit of U.S. Patent Application No. 62/354,707 filed on Jun. 25, 2016, U.S. Patent Application No. 62/355,677 filed on Jun. 28, 2016, and U.S. Patent Application No. 62/405,397 filed Oct. 7, 2016. This application claims the benefit of U.S. Patent Application No. 62/594,147 filed Dec. 4, 2017 and U.S. Patent Application No. 62/636,308 filed Feb. 28, 2018. The disclosures of the above applications are incorporated herein by reference.

FIELD

The disclosure relates to a valve train assembly comprising: at least a number of exhaust valves each having a valve stem; at least one camshaft with at least a pair of a primary lift cam and an engine brake lift cam; a number of rocker arms, each rocker arm having a valve stem actuation portion, a pivot axis parallel to the main cam shaft and a cam follower for following one of the primary lift cam and the engine brake lift cam; wherein each rocker arm having a cam follower following an engine brake lift cam is provided with an engine brake capsule, which is selectively translatable between a retracted and extended position, the retracted position disabling actuation of the valve by the engine brake lift cam and the corresponding rocker arm and the extended position enabling actuation of the valve.

BACKGROUND

Such a valve train assembly is known and used to provide engine brake functionality to a combustion engine. In the field, this type of engine brake is also called a Jake brake. For being able to brake with the engine, the compressed air at the end of the compression stroke of the cylinder needs to be released to the exhaust, such that the engine basically functions as an air compressor and thus consumes energy, which is derived from the drive train of the vehicle causing the vehicle to brake.

With the engine brake capsule one can select whether the engine brake lift cam can actuate an exhaust valve or not. In case the engine brake capsule is in extended position, the cam follower following the engine brake lift cam can actuate via the corresponding rocker arm an exhaust valve at the right moment to release the compressed air to the exhaust of the engine.

In retracted position of the engine brake capsule there will be too much lash between the engine brake lift cam and the corresponding exhaust valve for the cam to actuate the exhaust valve. Although this disables the engine braking and allows for normal operation of the engine, it will leave a substantial play for the corresponding rocker arm, such that the rocker arm can freely tilt up and down causing noise and additional wear.

It is therefore an object of the disclosure to reduce the above mentioned disadvantages. This object is achieved according to the disclosure with a valve train assembly according to the preamble, which is characterized by a number of biasing assemblies each one cooperating with one of the rocker arms of which the cam follower follows an engine brake lift cam to accommodate mechanical lash.

With the biasing assemblies the rocker arms with the cam follower following the engine brake lift cam is biased to a default position to accommodate the mechanical lash. This ensures that the rocker arm cannot tilt freely, reducing the noise and reducing the wear on the rocker arm.

SUMMARY in an example of the valve train assembly according to the present disclosure each rocker arm has a single valve stem actuation portion and two cam followers, one of which cam followers following a primary lift cam and one of which cam followers following an engine brake lift cam. Such a rocker arm has for example a Y-shape and allows for a single exhaust valve to be used as both the primary exhaust valve during normal operation of the engine as well as the release valve in the engine brake mode to release compressed air from the cylinder.

In another example of the valve train assembly according to the disclosure a pair of a primary lift cam and an engine brake lift cam has two corresponding rocker arms for actuating two corresponding valves. In this example the primary lift cam has a dedicated, corresponding rocker arm, which actuates a dedicated, corresponding exhaust valve, and has the engine brake lift cam a corresponding rocker arm to actuate a corresponding, separate exhaust valve.

In a preferred example of the valve train assembly according to the disclosure the valve stem actuation portion of the rocker arm corresponding to the primary lift cam overlaps with the valve stem actuation portion of the rocker arm corresponding to the engine brake lift cam, such that on actuation by the primary lift cam both valves are actuated. With this example, the primary lift cam can also actuate the exhaust valve corresponding to the engine brake lift cam due to the overlapping valve stem actuation portion. This allows for two exhaust valves to be used during normal engine operation, while still an engine brake functionality is provided.

In a further preferred example of the valve train assembly according to the disclosure each biasing assembly comprises a lever pivotably mounted to the rocker arm, a lost motion spring biased between the lever and the rocker arm and limiting means for limiting the rotation of the lever relative to the pivot axis of the rocker arm.

The limiting means provide for a small lash to be set by setting the spacing between the lever and the limiting means. During actuation of the rocker arm and the engine brake exhaust valve, the limiting means will contact the lever, blocking further movement of the lever, such that the lost motion spring is compressed and ensures that after actuation of the engine brake exhaust valve, the mechanical lash is accommodated for.

In a further example of the valve train assembly according to the disclosure the biasing assemblies further comprise a lash adjustment screw arranged between an end of the lever and the rocker arm. The adjustment screw allows for setting the mechanical lash between the lever and the limiting means, such that the operation of the valve train assembly can be optimized.

In yet another example of the valve train assembly according to the disclosure the lever and lost motion spring are embodied as a leaf spring or as a spiral spring arranged around the pivot axis of the rocker arm. By embodying the lever and lost motion spring as a single element, i.e. a leaf spring or spiral spring, the number of parts is reduced in the valve train assembly.

In still a further example of the valve train assembly according to the disclosure the biasing means comprises a return cam follower arranged on the opposite side of the cam shaft and facing the cam follower following the engine brake lift cam. With both a cam follower for the engine brake lift cam and a return cam follower, the corresponding rocker arm is controlled in both tilting directions. This ensures that the rocker arm cannot tilt freely and mechanical lash is accommodate for.

A compliance spring can be arranged between the return cam follower and rocker arm. This allows for both cam followers to be positioned on a desired opposite position, while any lash is eliminated. If no compliance spring is used, some lash could occur do to asymmetry between contact positions of both cam followers on the same cam lobe.

In a further preferred example of the valve train assembly according to the disclosure a return lift cam is provided on the cam shaft and the return cam follower follows the return lift cam. The separate return lift cam allows for a small lash by designing the engine brake lift cam lobe profile and the return lift cam lobe profile, while still the tilting movement in both directions of the rocker arm is fully controlled.

In yet another example of the valve train assembly according to the disclosure the biasing means comprise a torsion spring arranged between the pivot axis of the rocker arm and the rocker arm. Preferably, the torsion spring comprises at least one coil spring tangentially arranged between the pivot axis and the rocker arm.

A further example of the valve train assembly according to the disclosure further comprises a friction element arranged between the rocker arm and said pivot axis. The friction element prevents any free tilting movement of the rocker arm, even when a small lash is provided for. This will further reduce noise and wear. However, if the cam actuates the rocker arm, the friction element will allow for movement of the rocker arm. Preferably, the pivot axis is provided by a rocker shaft, wherein the friction element is provided by a tangential groove arranged in the rocker shaft and a spring loaded ball arranged between the rocker arm and the tangential groove.

The spring loaded ball will press into the tangential groove, such that free movement of the rocker arm is counteracted. However, if the cam actuates the rocker arm, the spring loaded ball can move through the tangential groove allowing for the tilting movement of the rocker arm.

In another preferred example of the valve train assembly according to the disclosure the friction element is a centripetal clutch. The clutch will prevent free movement of the rocker arm, but on sudden rotation due to actuation of the cam, the clutch will disengage and allow for the rocker arm to follow the cam.

In still a further example of the valve train assembly according to the disclosure the engine brake capsule comprises a cylinder and a piston arranged in the cylinder, wherein the piston is arranged to either the cam follower or the valve stem actuation portion and wherein a fluid channel is provided in the rocker arm to supply the cylinder space of the engine brake capsule with pressurized fluid in order selectively translate the piston between a retracted and extended position.

The pressurized fluid can for example be fed via a channel extending through the rocker arm shaft, such that all engine brake capsules in the valve train assembly can be extended or retracted at the same time.

A rocker arm assembly operable in a first mode and a second mode selectively opens first and second engine valves based on rotation of a cam shaft having a first cam lobe and a second cam lobe. The rocker arm assembly includes a rocker shaft, a first and second rocker arm assemblies and a biasing assembly. The first rocker arm assembly has a first rocker arm that receives the rocker shaft and is configured to rotate around the rocker shaft in the first mode based on engagement with the first cam lobe. The second rocker arm assembly has a second rocker arm that receives the rocker shaft and is configured to rotate around the rocker shaft and selectively act on one of the first and second engine valves in the second mode based on selective engagement with the second cam lobe. The biasing assembly cooperates with the second rocker arm to bias the second rocker arm to a neutral position. In the neutral position, the second rocker arm is spaced from contact relative to both of the second cam lobe and the second engine valve.

According to other features, the biasing assembly further includes a spring plate assembly having a first spring plate, a second spring plate and at least one biasing member. The first spring plate is fixed relative to the rocker shaft. The second spring plate is fixed for rotation with the second rocker arm. The at least one biasing member is disposed relative to the first and second spring plates and is configured to load and unload based on rotation of the second rocker arm around the rocker shaft. The spring plate assembly can define at least one window that is configured to receive the at least one biasing member. The at least one window is defined in part by a first bearing surface on the first spring plate and a second bearing surface on the second spring plate. The at least one biasing member bears against the respective first and second baring surfaces during rotation of the second rocker arm around the rocker shaft.

In other features, the spring plate assembly comprises at least one spring retainer configured to retain the at least one biasing member within the at least one window. The first plate can define at least one slot. The second plate can define at least one aperture. A fastener extends through the at least one slot and the at least one aperture and is threadably secured into a threaded bore defined in the second rocker arm. The second spring plate rotates relative to the first spring plate while the fastener travels along the at least one slot during rotation of the second rocker arm during operation in the second mode.

According to additional features, the second rocker arm includes a capsule configured to move between a retracted position and an extended position. In the retracted position, the biasing assembly biases the second rocker arm to the neutral position. In the extended position, the second rocker arm is caused to rotate toward the second cam lobe preloading the biasing assembly.

In additional features, an orientation system can include a key extending from the camshaft. A keyway can be define don the first plate. A pair of opposed stops can define a rotational limitation slot on the second plate. The key is fixed to the first plate at the keyway. Rotation of the second rocker arm is limited by engagement of the key with the opposed stops on the second plate.

In one arrangement, the first rocker arm assembly is an exhaust valve rocker arm assembly and the second rocker arm assembly is an engine brake rocker arm assembly. The exhaust valve rocker arm assembly includes an exhaust rocker arm and a valve bridge. The valve bridge has a lever pivotally coupled thereto such that during operation in the second mode, the engine brake rocker arm does not transfer motion to the valve bridge. In one configuration, the first and second engine valves are exhaust valves and one of the first and second modes includes early exhaust valve opening (EEVO). In another configuration, the first and second engine valves are intake valves and wherein one of the first and second modes includes late intake valve closing (LIVC).

A rocker arm assembly operable in a first mode and a second mode selectively opens first and second engine valves based on rotation of a cam shaft having a first cam lobe and a second cam lobe. The rocker arm assembly includes a rocker shaft, a first and second rocker arm, a capsule and a spring plate assembly. The first rocker arm is configured to rotate around the rocker shaft in the first mode based on engagement with the first cam lobe. The second rocker arm is configured to rotate around the rocker shaft and selectively act on one of the first and second engine valves in the second mode based on selective engagement with the second cam lobe. The capsule is arranged on the second engine brake rocker arm and is configured to move between an extended position and a retracted position. The spring plate assembly cooperates with the second rocker arm to bias the second rocker arm to a neutral position when the capsule is in the retracted position. In the neutral position, the second rocker arm is spaced from contact relative to both of the second cam lobe and the second engine valve. The spring plate assembly includes a first spring plate, a second spring plate and at least one biasing member. The first spring plate is fixed relative to the rocker shaft. The second spring plate is fixed for rotation with the second rocker arm. The at least one biasing member selectively biases against the first and second spring plates upon rotation of the second rocker arm.

The spring plate assembly can define at least one window that is configured to receive the at least one biasing member. The at least one window is defined in part by a first bearing surface on the first spring plate and a second bearing surface on the second spring plate. The at least one biasing member bears against the respective first and second baring surfaces during rotation of the second rocker arm around the rocker shaft.

In other features, the spring plate assembly comprises at least one spring retainer configured to retain the at least one biasing member within the at least one window. The first plate can define at least one slot. The second plate can define at least one aperture. A fastener extends through the at least one slot and the at least one aperture and is threadably secured into a threaded bore defined in the second rocker arm. The second spring plate rotates relative to the first spring plate while the fastener travels along the at least one slot during rotation of the second rocker arm during operation in the second mode.

In additional features, in the extended position, the second rocker arm is caused to rotate toward the second cam lobe preloading the biasing assembly. An orientation system can include a key extending from the camshaft. A keyway can be define don the first plate. A pair of opposed stops can define a rotational limitation slot on the second plate. The key is fixed to the first plate at the keyway. Rotation of the second rocker arm is limited by engagement of the key with the opposed stops on the second plate.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed examples and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DETAILED DESCRIPTION

The following discussion is set forth in the context of rocker arms for opening exhaust valves configured in a compression engine braking system. The discussion focuses on a camshaft having a primary lift cam and an engine brake lift cam. It will be appreciated that the disclosure is not so limited. For example, the present disclosure can also be additionally or alternatively applicable to exhaust valves in other non-compression brake systems. Moreover, the disclosure may also be applicable to intake valves. In this regard, the camshaft can be configured with a primary lift cam and a secondary lift cam. For example, the present disclosure can also be applicable to valvetrains configured for early exhaust valve opening (EEVO), late intake valve closing (LIVC) or other variable valve actuation (VVA) configurations.

Heavy duty (HD) diesel engines with single overhead cam (SOHC) valve train requires high braking power, in particular at low engine speed. The present disclosure provides an added motion type de-compression engine brake. To provide high braking power without applying high load on the rest of the valve train (particularly the camshaft), the present disclosure provides a dedicated rocker arm for engine brake that acts on one exhaust valve. In this regard, half of the input load is experienced compared to other configurations that have two exhaust valves opening.

Figure 1:
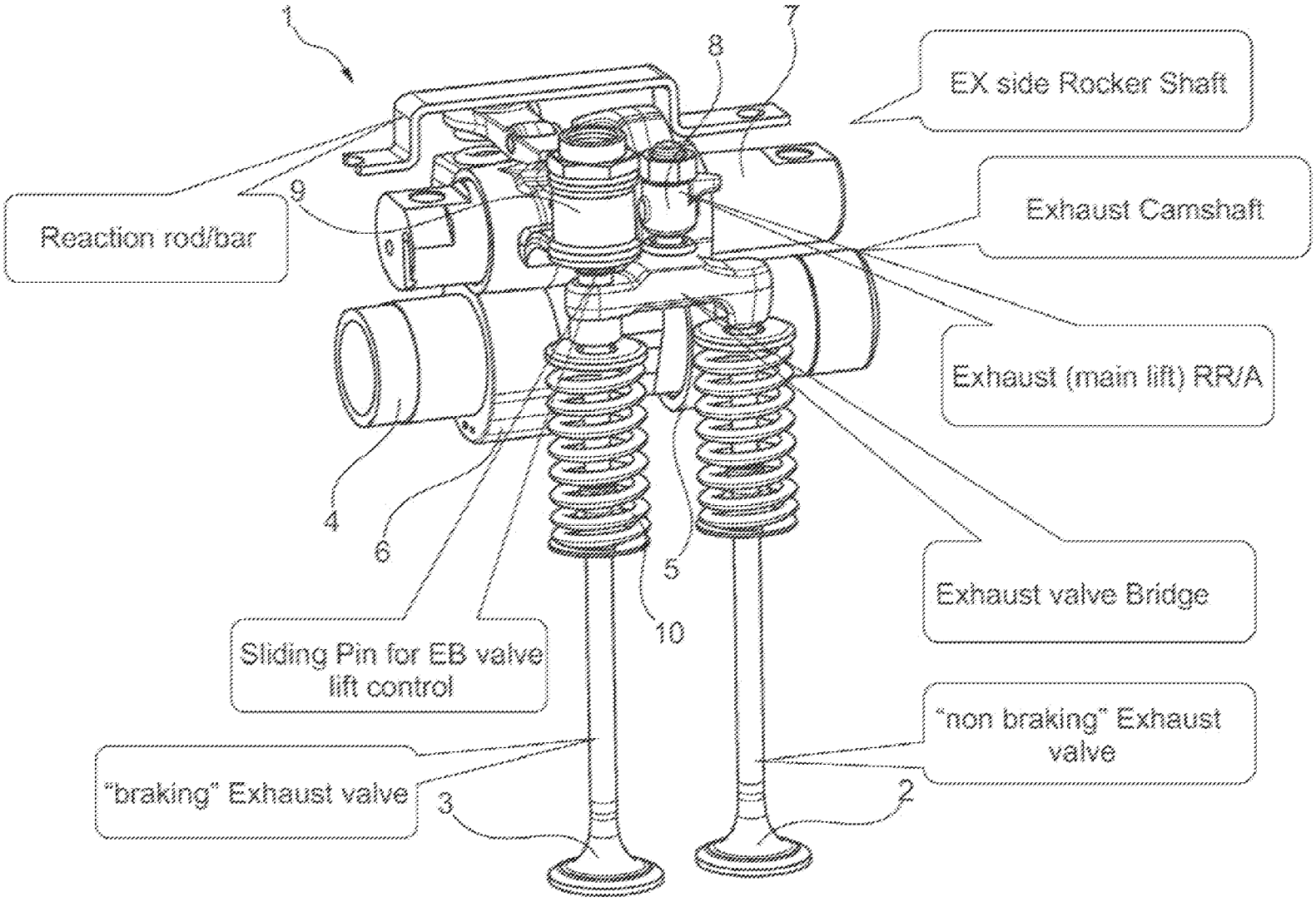
FIG. 1 shows a perspective view of a first example of a valve train assembly according to the disclosure.

FIG. 1 shows a perspective view of a first example of a valve train assembly 1 according to the disclosure. The valve train assembly 1 has a primary exhaust valve 2 and a brake exhaust valve 3. A cam shaft 4 is provided with pairs of a primary lift cam 5 and an engine brake lift cam 6.

A rocker shaft 7 is provided parallel to the cam shaft 4. A main rocker arm 8 and an engine brake rocker arm 9 are pivotably arranged on said rocker shaft 7. The engine brake rocker arm 9 acts directly on the brake exhaust valve 3, while the main rocker arm 8 acts on a bridge 10, such that both the primary exhaust valve 2 and the engine brake valve 3 can be actuated simultaneous. To this end, the engine brake rocker arm 9 extends through the bridge part 10 to be able to actuate the brake exhaust valve 3 separately.

Figure 2:
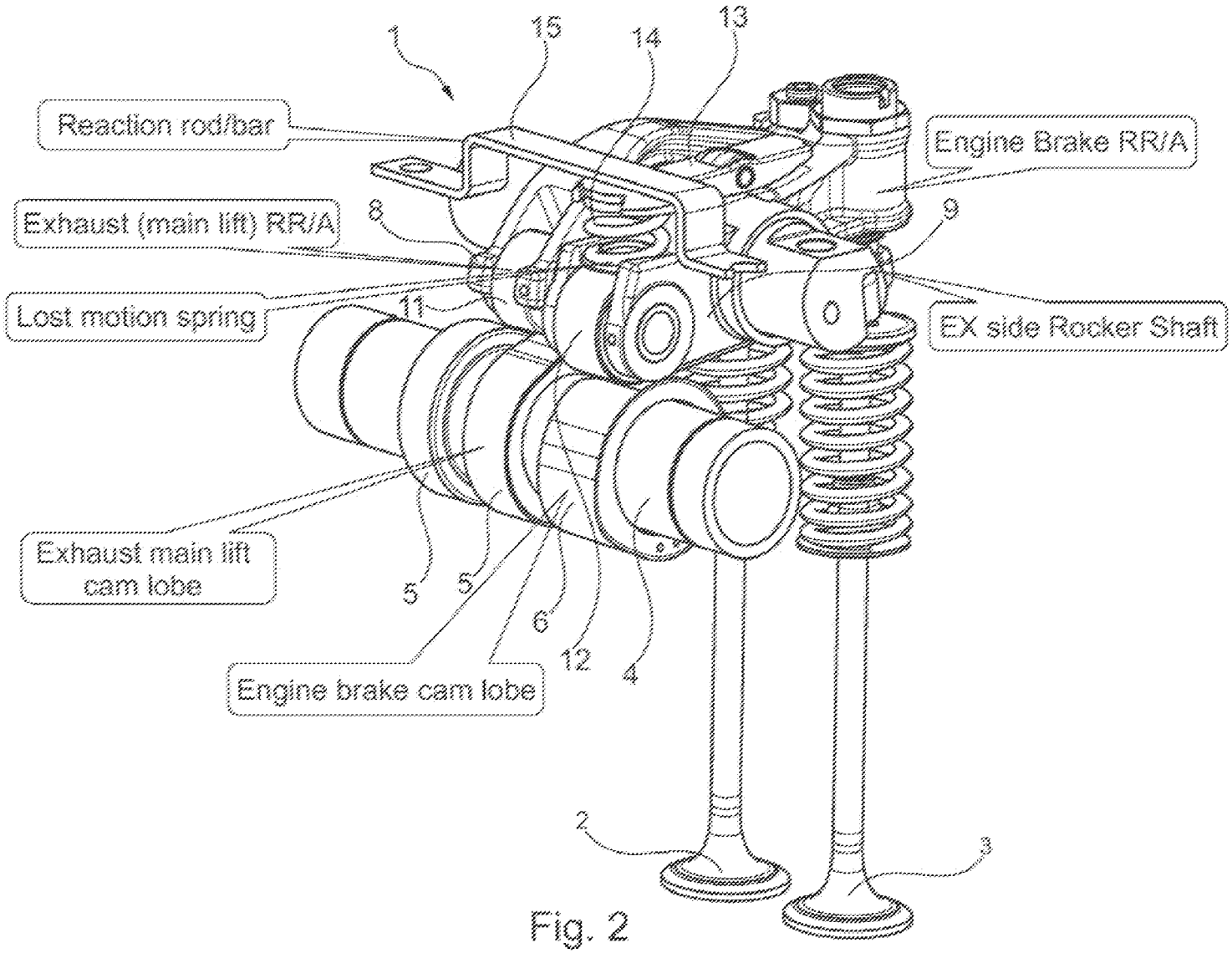
FIG. 2 shows a perspective view of the back side of the assembly of FIG. 1.

FIG. 2 shows a perspective view of the back side of the assembly 1 of FIG. 1. The main rocker arm 8 has a roper 11, which follows the profile of the primary lift cam 5 to actuate the primary exhaust valve 2. The engine brake rocker arm 9 also has a roller 12 which follows the profile of the engine brake rocker arm 9 to actuate the engine brake exhaust valve 3. The rocker arm 9 is provided with a lever 13 pivotably arranged on top of the rocker arm 9. A lost motion spring 14 is arranged between the lever 13 and the rocker arm 9 to accommodate for any lash. The pivoting of the lever 13 is limited by the bridge part 15, which ensures that the lost motion spring 14 is compressed on actuation of the rocker arm 9 and that the rocker arm 9 returns to its default position.

Figure 3:
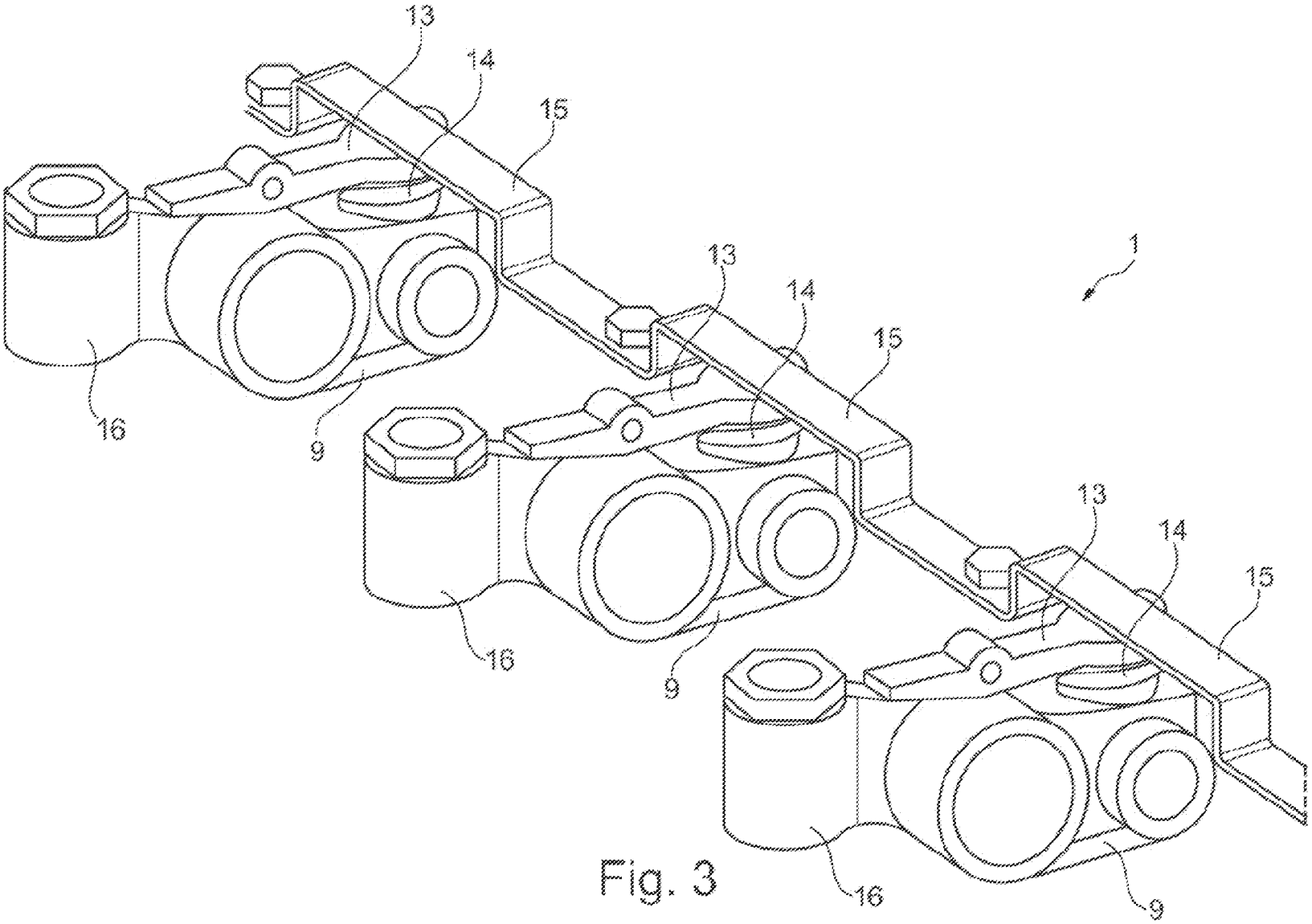
FIG. 3 shows a perspective view of engine brake rocker arms of FIG. 1 arranged side by side.
Figure 4:
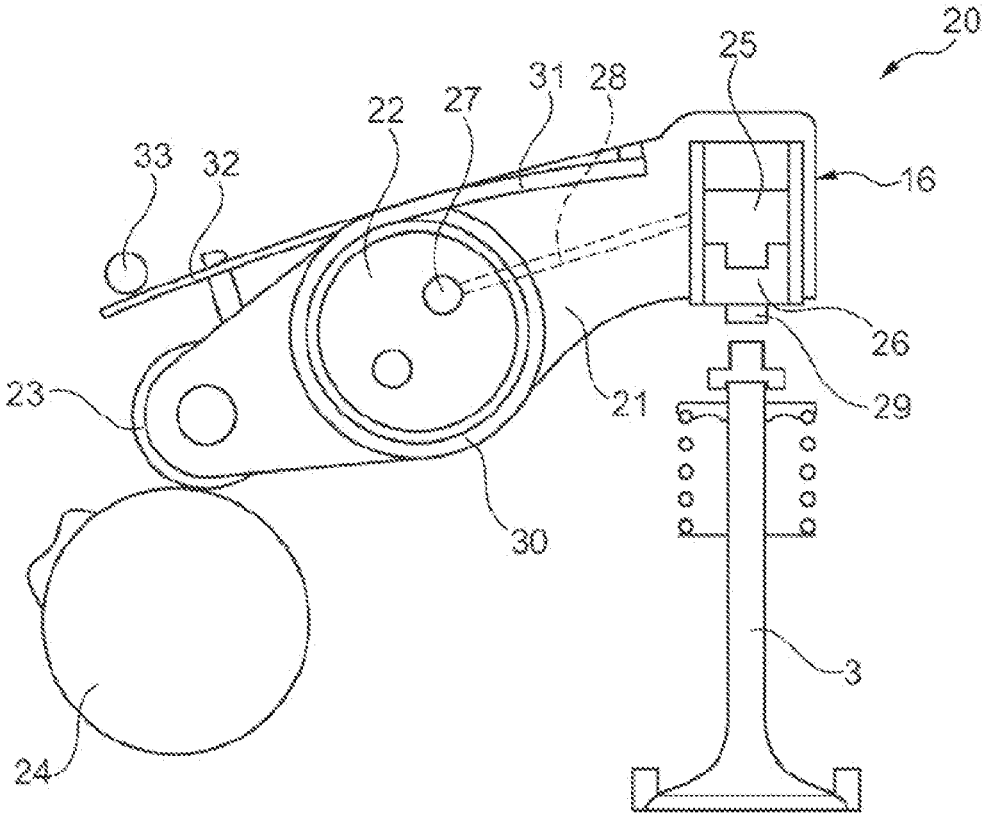
FIGS. 4-6 show schematically the operation of a second example of the valve train assembly according to the disclosure.

FIG. 3 shows a perspective view of engine brake rocker arms 9 of FIG. 1 arranged side by side. One end of each engine brake rocker arm 9 is provided with an engine brake capsule 16 which will be explained in FIGS. 4-6. FIG. 4 shows a second example 20 of a valve train assembly according to the disclosure. The example 20 has an engine brake rocker arm 21 pivotably arranged on a rocker shaft 22. One end of the rocker arm 21 is provided with a roller 23 for following an engine brake lift cam 24. The other end of the rocker arm 21 is provided with an engine brake capsule 16.

The engine brake capsule 16 has a cylinder 25 in which a piston 26 is movably arranged. Via a supply channel 27 in the rocker shaft 22 and a supply channel 28 in the rocker arm 21, the cylinder space 25 can be supplied with pressurized fluid, which causes the piston 26 to extend or to retract. The piston 26 is provided with a valve stem actuation portion 29, which actuates the valve stem head of the engine brake valve 3.

The rocker arm 21 is furthermore provided with a biasing assembly in the form of a spiral spring 30, which is folded around the rocker shaft 22. On end 31 of the spiral spring 30 is connected to the rocker arm 21, while the other end 32 is limited by a rod 33, similar to the bridge portion 15 of the example 1.

Figure 5:
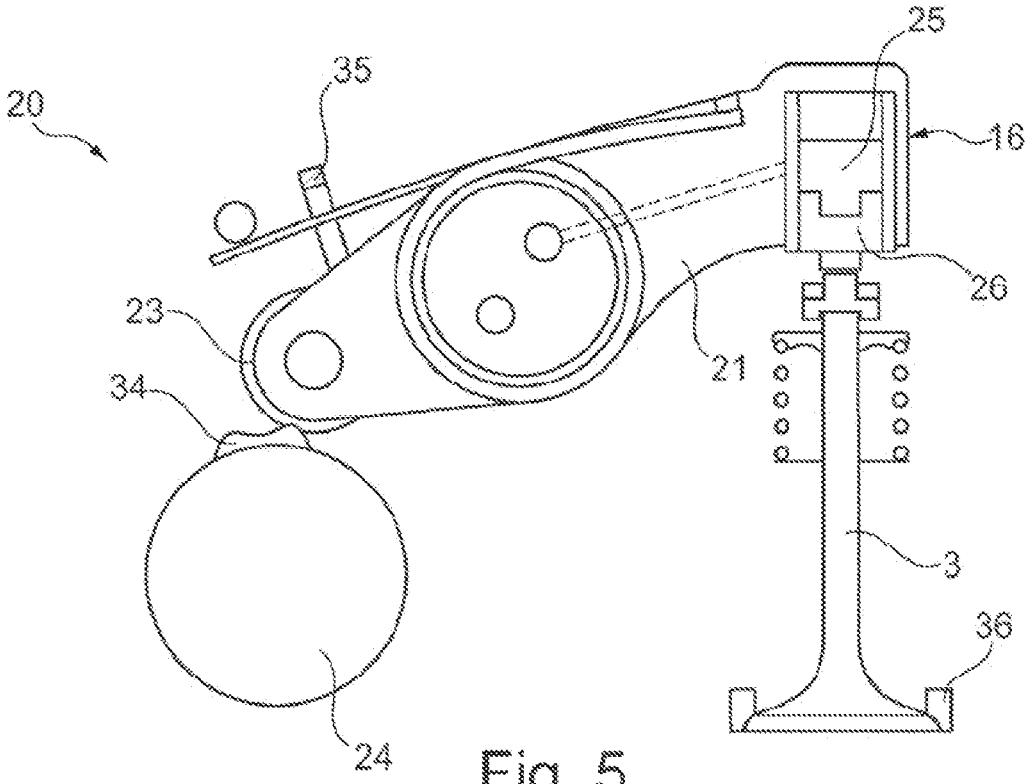
Figure 6:
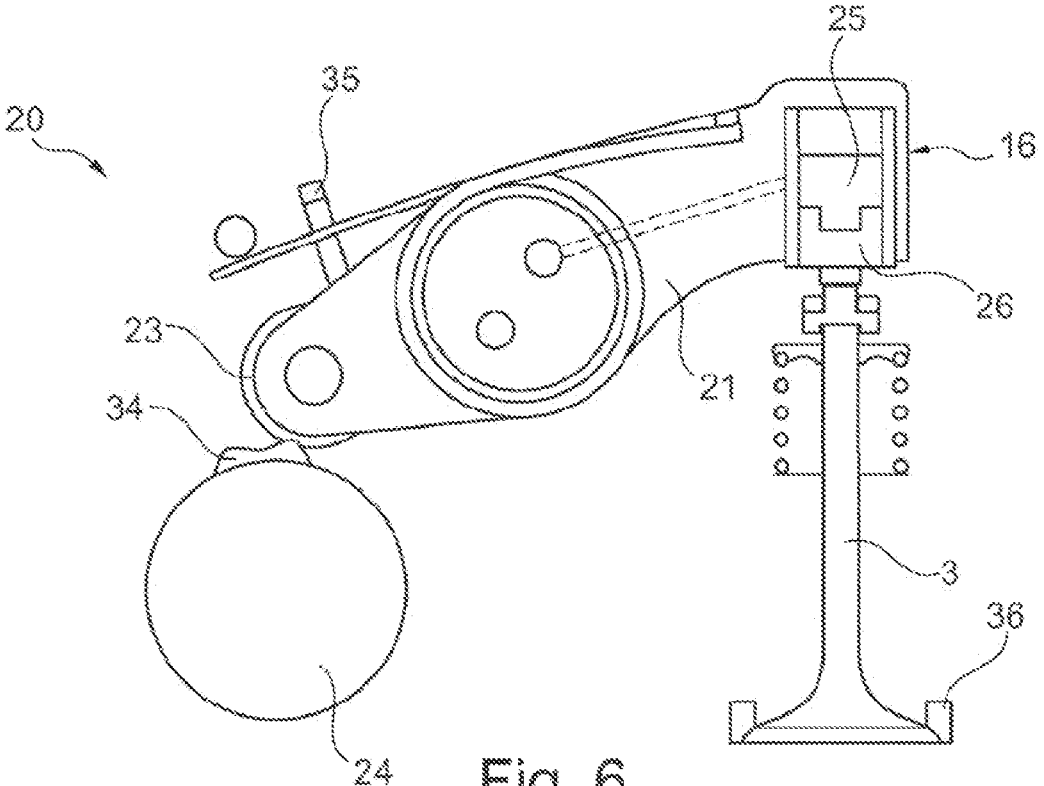

FIGS. 5 and 6 both show the example 20 when the lobe 34 on the engine brake lift cam 24 pushes the roper 23 upwards and causes the rocker arm 21 to tilt. The tilting can be seen by the end 32 of the spiral spring 30, which is free from the hook part 35. In FIG. 5, the cylinder space 25 is not provided with pressurized fluid, such that the piston 26 is in the retracted position and the valve 3 is not actuated and remains seated to its seat 36. Now when the lobe 34 passes the roller 23, the spiral spring 30 will move the rocker arm 21 back into the position shown in FIG. 4.

Figure 7:
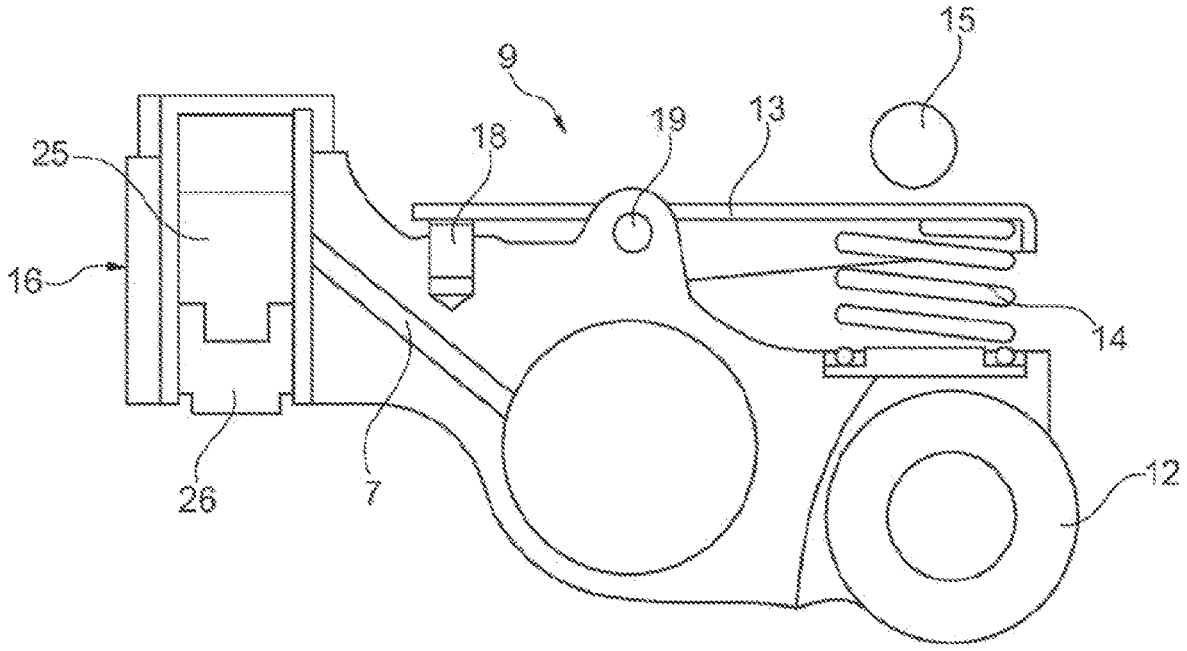
FIG. 7 shows a third example of an engine brake rocker arm for a valve train assembly according to the disclosure.

In FIG. 6, the cylinder chamber 25 is provided with pressurized fluid, such that the piston 26 is in the extended position and actuates the valve 3 such that the valve head is moved away from the valve seat 36 and pressurized air from the engine cylinder can pass to an exhaust. FIG. 7 shows the engine brake rocker arm 9 in detail. The rocker arm 9 is provided with an engine brake capsule 16, which has a cylinder space 25 and a piston 26. The cylinder space 25 is connected to a fluid channel 17.

The lever 13 is arranged to the rocker arm 9 via pivot axle 19. A lash adjustment screw 18 is provided between the lever 13 and the rocker arm 9 to set some lash between the lever 13 and the bridge 15.

Figure 8:
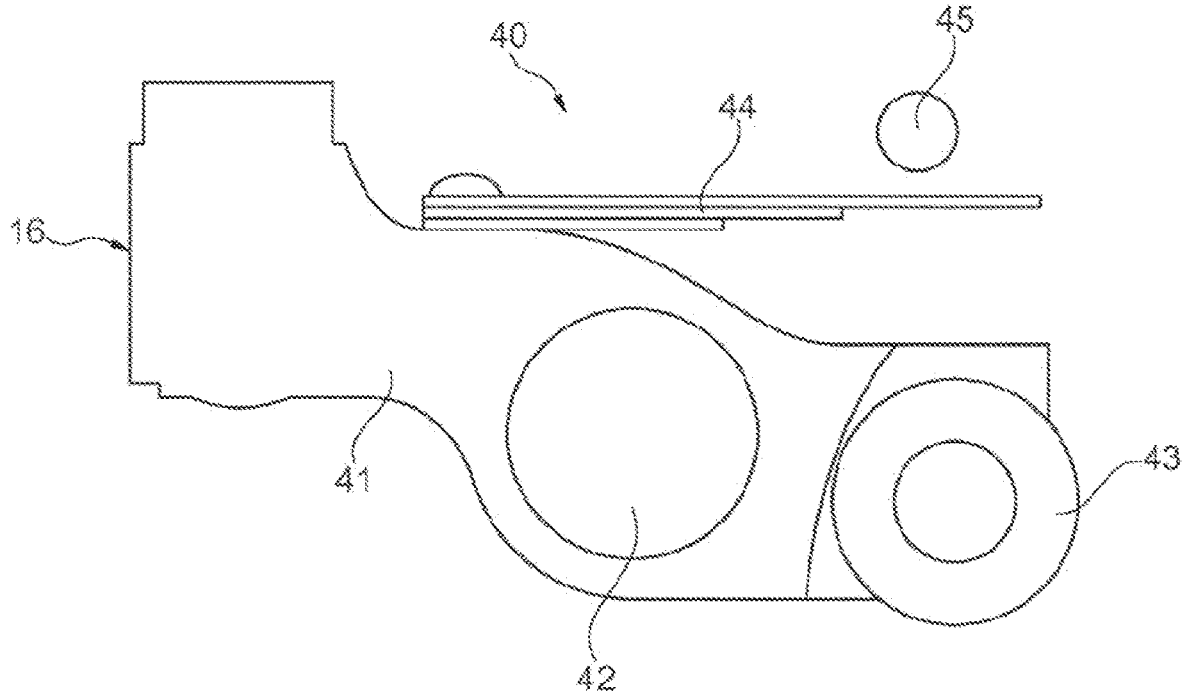
FIG. 8 shows a fourth example of an engine brake rocker arm for a valve train assembly according to the disclosure.

FIG. 8 shows a fourth example 40 of an engine brake rocker arm for a valve train assembly according to the disclosure. The rocker arm body 41 is provided with an opening 42 for the rocker shaft, an engine brake capsule 16 on one end and a roller 43 on the other end. A biasing assembly in the form of a leaf spring 44 is mounted on top of the rocker arm body 41 to accommodate lash. The free end of the leaf spring 44 is limited by a rod 45

Figure 9:
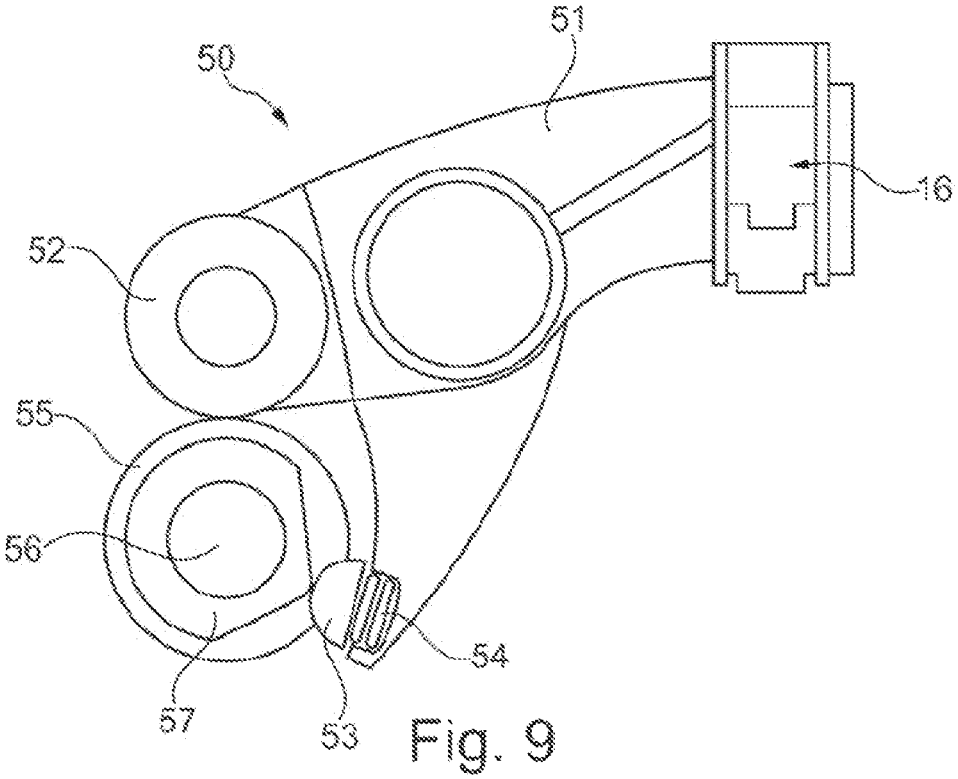
FIG. 9 shows a fifth example of an engine brake rocker arm for a valve train assembly according to the disclosure.

FIG. 9 shows a fifth example 50 of an engine brake rocker arm for a valve train assembly according to the disclosure. The rocker arm has a Y-shaped rocker arm body 51 with on one hand of the Y-shape a first roller 52 and on the other hand of the Y-shape a follower 53. This follower 53 is spring loaded by a compliance spring 54.

The engine brake lift cam 55 on the camshaft 56 is followed by the roller 52, while the additional return lift cam 57 is followed by the follower 53. This arrangement ensures that the mechanical lash is accommodated for and that the rocker arm 51 cannot move freely.

Figure 10:
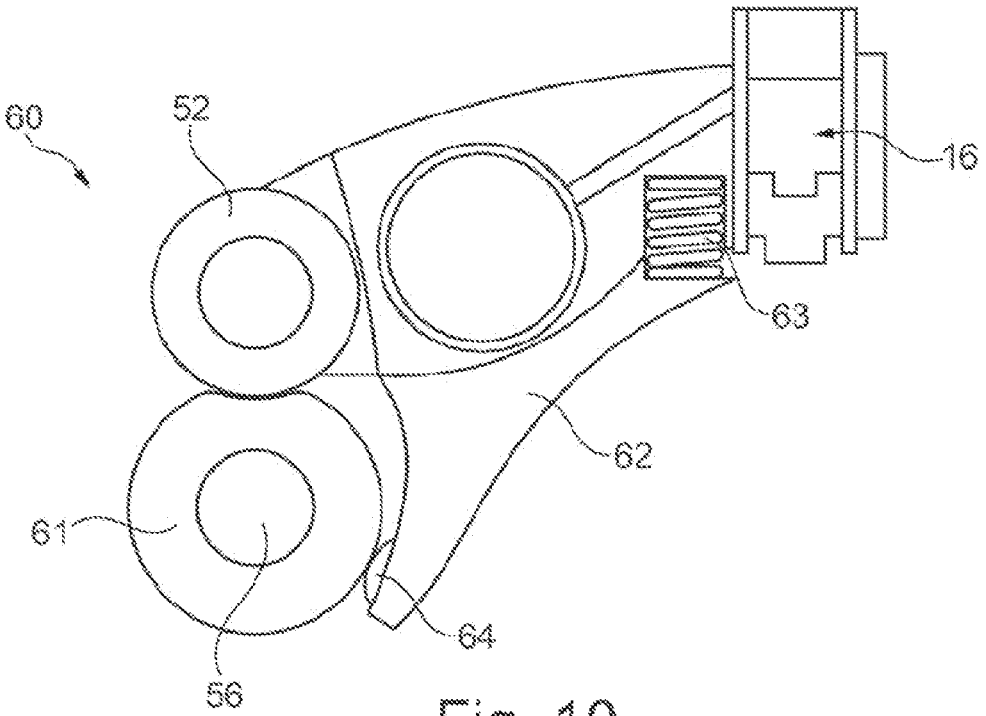
FIG. 10 shows a sixth example of an engine brake rocker arm for a valve train assembly according to the disclosure.

FIG. 10 shows a sixth example 60 of an engine brake rocker arm for a valve train assembly according to the disclosure. This example is variant of the example 50 and similar parts are provided with the same reference signs.

The rocker arm 60 has a first roller 52 which follows the profile of the engine brake lift cam 61. A separate arm 62 is pivotably arranged to the rocker arm 60 and spring loaded by a compliance spring 63. The separate arm 62 is provided with a follower 64, such that lash is accommodated for. As the roller 52 and follower 64 follow the same profile the compliance spring 63 and pivot able arranged separate arm 62 accommodate for any distance differences between the roller 52 and the follower 64.

Figure 11:
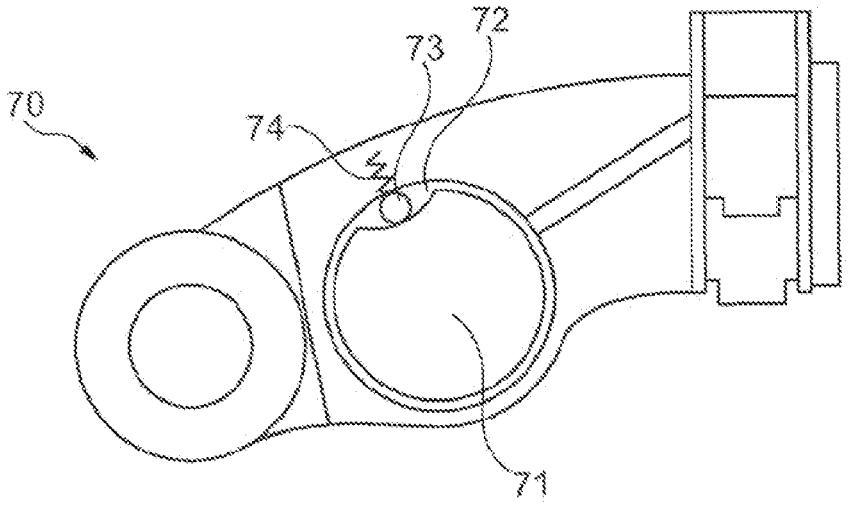
FIG. 11 shows a seventh example of an engine brake rocker arm for a valve train assembly according to the disclosure.

FIG. 11 shows a seventh example 70 of an engine brake rocker arm for a valve train assembly according to the disclosure. The engine brake rocker arm 70 is arranged on a rocker shaft 71. The rocker shaft 71 is provided with a tangential groove 72 in which a ball 73 is positioned. This ball is urged by a spring 74 arranged to the rocker arm 70. This ensures that the rocker arm 70 is urged to a default position and thus any lash is accommodated for.

Figure 12:
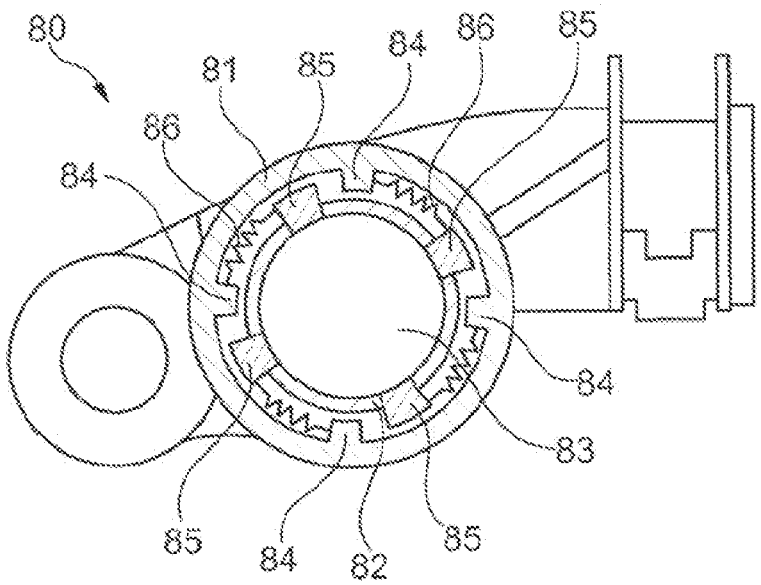
FIG. 12 shows a eighth example of an engine brake rocker arm for a valve train assembly according to the disclosure.

FIG. 12 shows an eighth example 80 of an engine brake rocker arm for a valve train assembly according to the disclosure. This rocker arm 80 is provided with a torsion spring comprising an outer housing ring 81 and an inner housing ring 82, which is fixedly arranged to the rocker shaft 83. The outer housing ring 81 and the inner ring 82 are provided with interlocking protrusions 84, 85 between which coil springs 86 are arranged.

Now when the rocker arm 80 is tilted, the outer housing ring 81 will be rotated relative to the inner housing ring 82, such that the coil springs 86 are compressed. As soon as the rocker arm 80 is released, the coil springs 86 will urge the rocker arm 80 back to its default position and accommodate for any lash.

Figure 13:
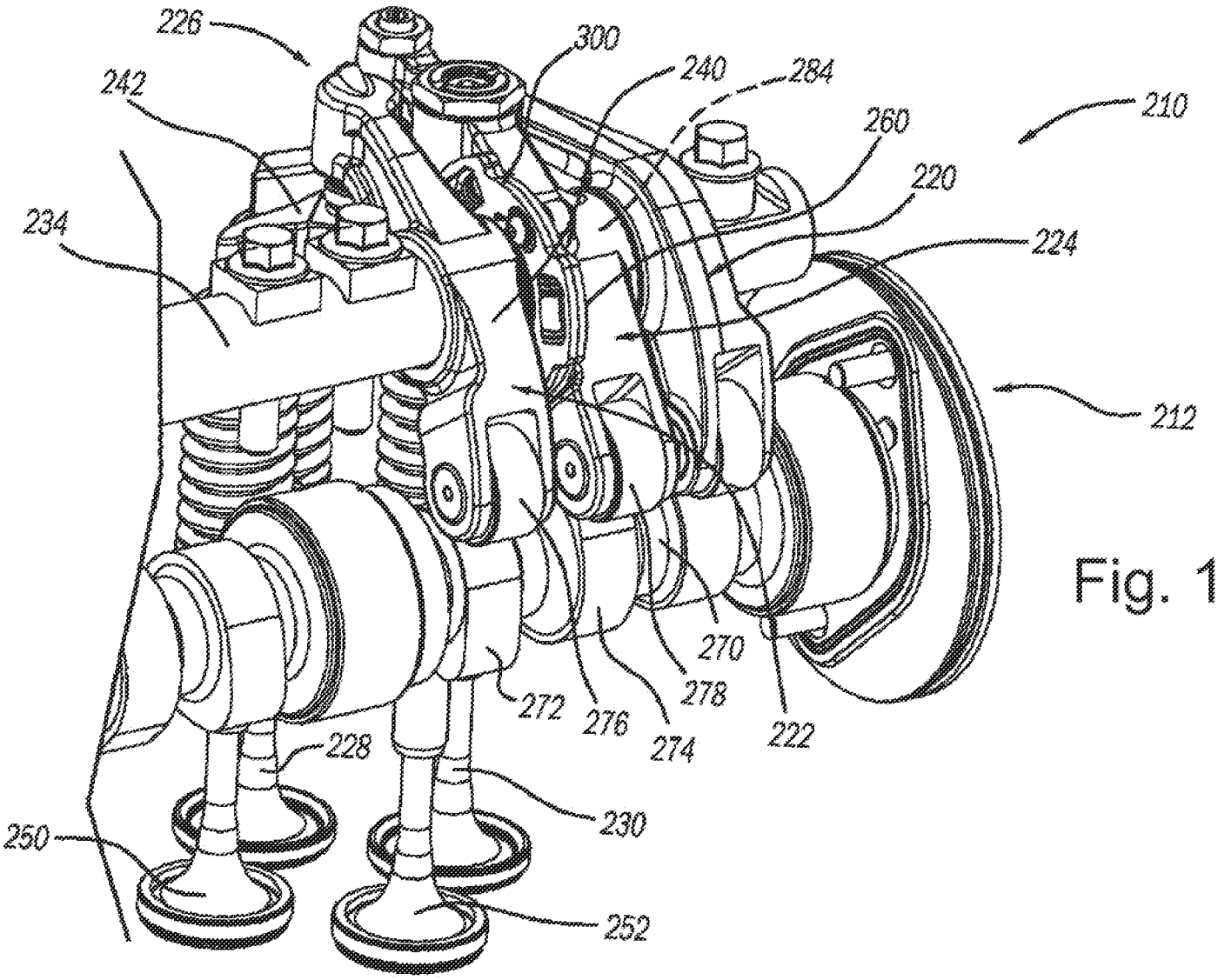
FIG. 13 is a first perspective view of a partial valve train assembly incorporating a rocker arm assembly including an intake rocker arm, an exhaust rocker arm and an engine brake rocker arm having a biasing assembly constructed in accordance to one example of the present disclosure.

With reference now to FIG. 13, a partial valve train assembly constructed in accordance to another example of the present disclosure is shown and generally identified at reference 210. The partial valve train assembly 210 utilizes engine braking and is shown configured for use in a three-cylinder bank portion of a six-cylinder engine. It will be appreciated however that the present teachings are not so limited. In this regard, the present disclosure may be used in any valve train assembly that utilizes engine braking or other valvetrains such as those discussed above. The partial valve train assembly 210 is supported in a valve train carrier 212 and can include three rocker arms per cylinder.

Specifically, each cylinder includes an intake valve rocker arm assembly 220, a first or exhaust valve rocker arm assembly 222 and a second or engine brake rocker arm assembly 224. The exhaust valve rocker arm assembly 222 and the engine brake rocker arm assembly 224 cooperate to control opening of the exhaust valves and are collectively referred to as a dual exhaust valve rocker arm assembly 226. The intake valve rocker arm assembly 220 is configured to control motion of intake valves 228, 230. The exhaust valve rocker arm assembly 222 is configured to control exhaust valve motion in a drive mode. The engine brake rocker arm assembly 224 is configured to act on one of the two exhaust arms in an engine brake mode as will be described herein. A rocker shaft 234 is received by the valve train carrier 212 and supports rotation of the exhaust valve rocker arm assembly 222 and the engine brake rocker arm assembly 224.

Figure 14:
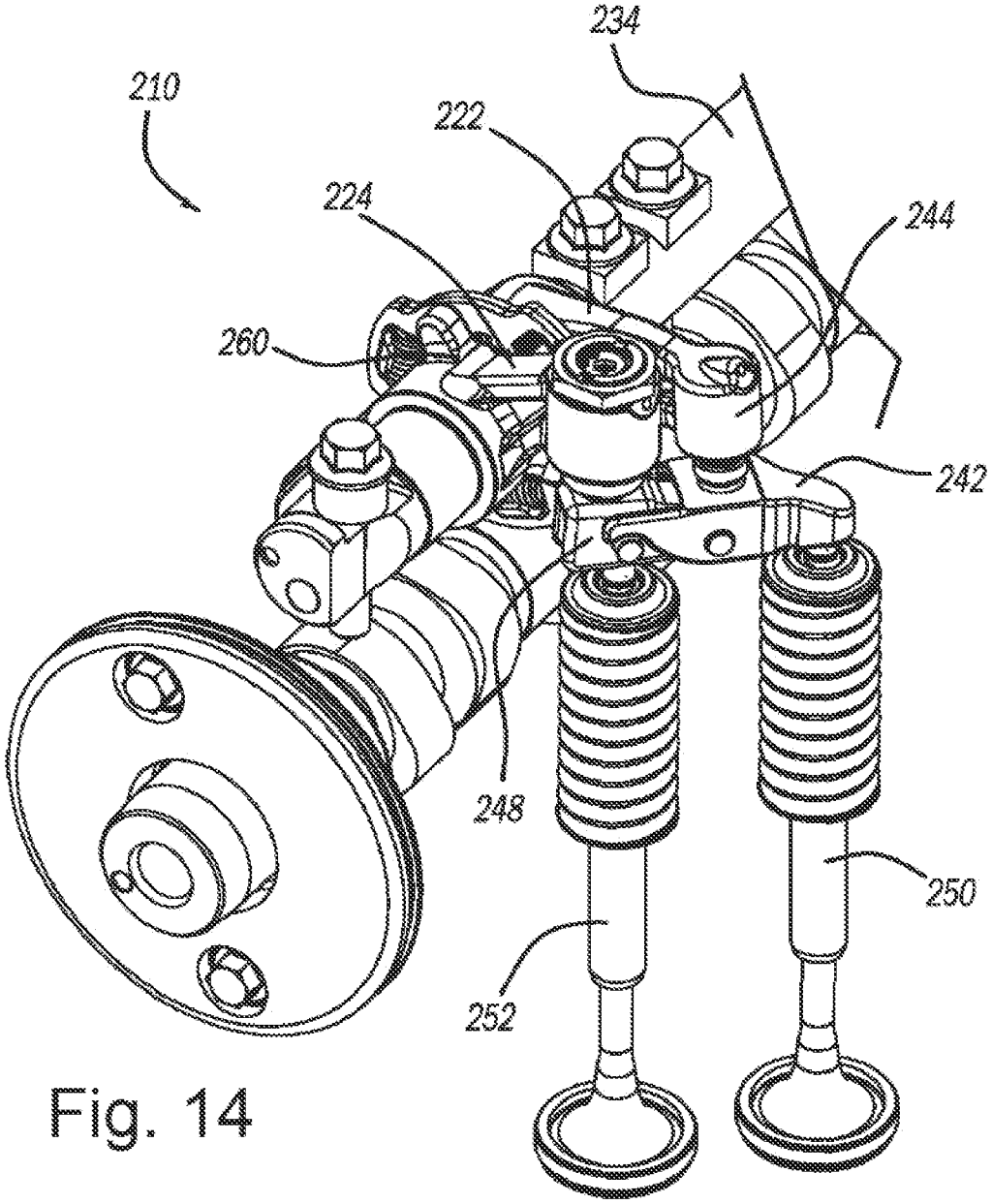
FIG. 14 is a second perspective view of the partial valve train assembly of FIG. 13 and shown with the intake rocker arm and associated intake valves removed for illustrative purposes.
Figure 15:
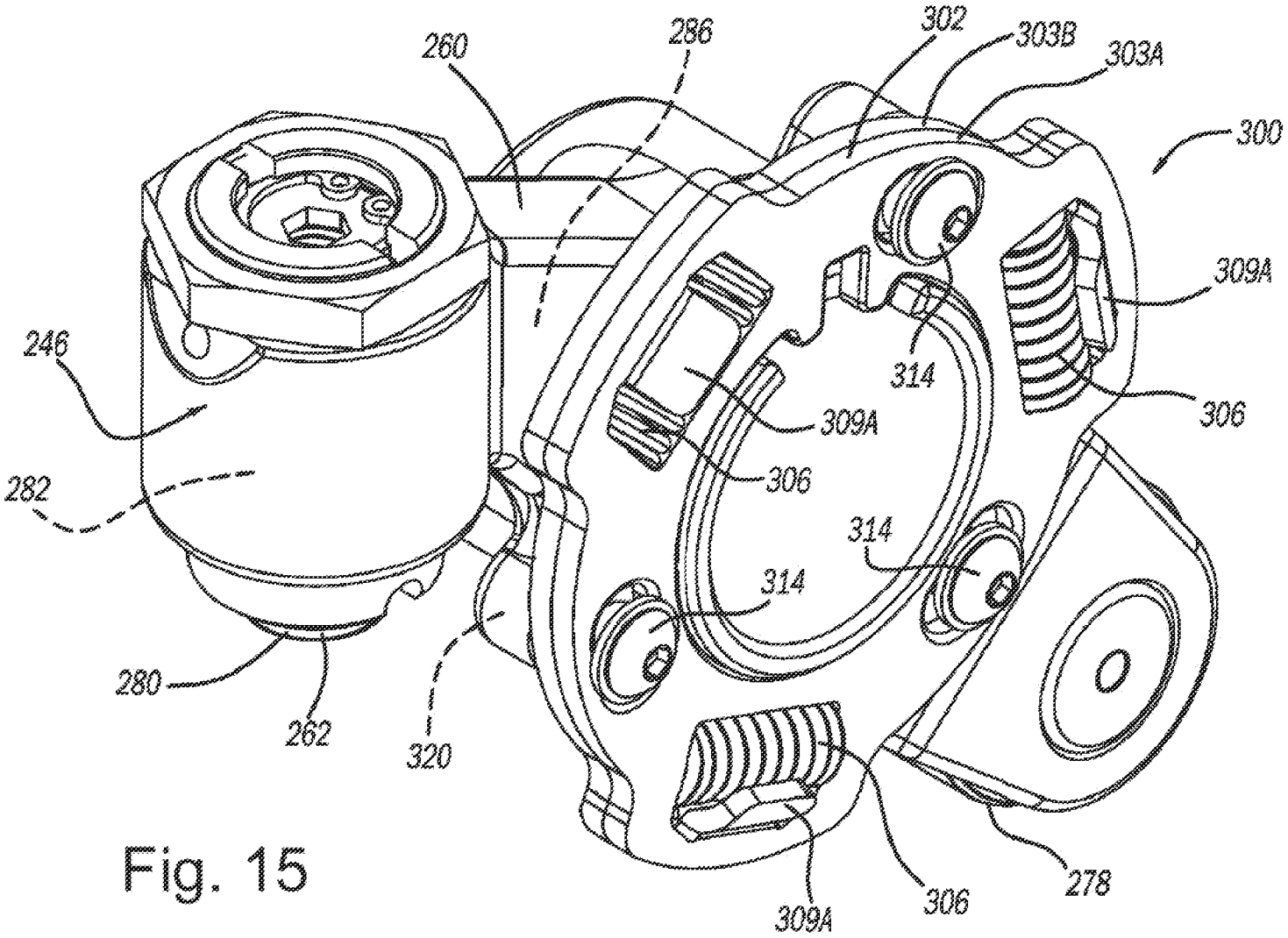
FIG. 15 is a first perspective view of the engine brake rocker arm and associated biasing assembly.

With continued reference to FIG. 13 and additional reference to FIG. 14, the exhaust valve rocker arm assembly 222 can generally include an exhaust rocker arm 240, a valve bridge 242, and a spigot assembly 244. A lever 248 can be pivotably coupled to the valve bridge 242 such that during a braking event an engine brake rocker arm 260 does not transfer motion to the valve bridge 242. The engine brake rocker arm assembly 224 can include the engine brake rocker arm 260 having an engaging portion 262 (FIG. 15). The valve bridge 242 engages a first and second exhaust valve 250 and 252 (FIG. 13) associated with a cylinder of an engine (not shown).

A camshaft 270 includes an exhaust main lift cam lobe 272 and an engine brake cam lobe 274. The exhaust rocker arm 240 has a first roller 276. The engine brake rocker arm 260 has a second roller 278. The first roller 276 rotatably engages the exhaust main lift cam lobe 272. As will be described in greater detail herein, the second roller 278 is configured to selectively rotatably engage the engine brake cam lobe 274. The exhaust rocker arm 240 rotates around the rocker shaft 234 based on a lift profile of the exhaust main lift cam lobe 272. The engine brake rocker arm 260 rotates around a rocker shaft 34 based on a lift profile of the engine brake cam lobe 274.

Figure 16:
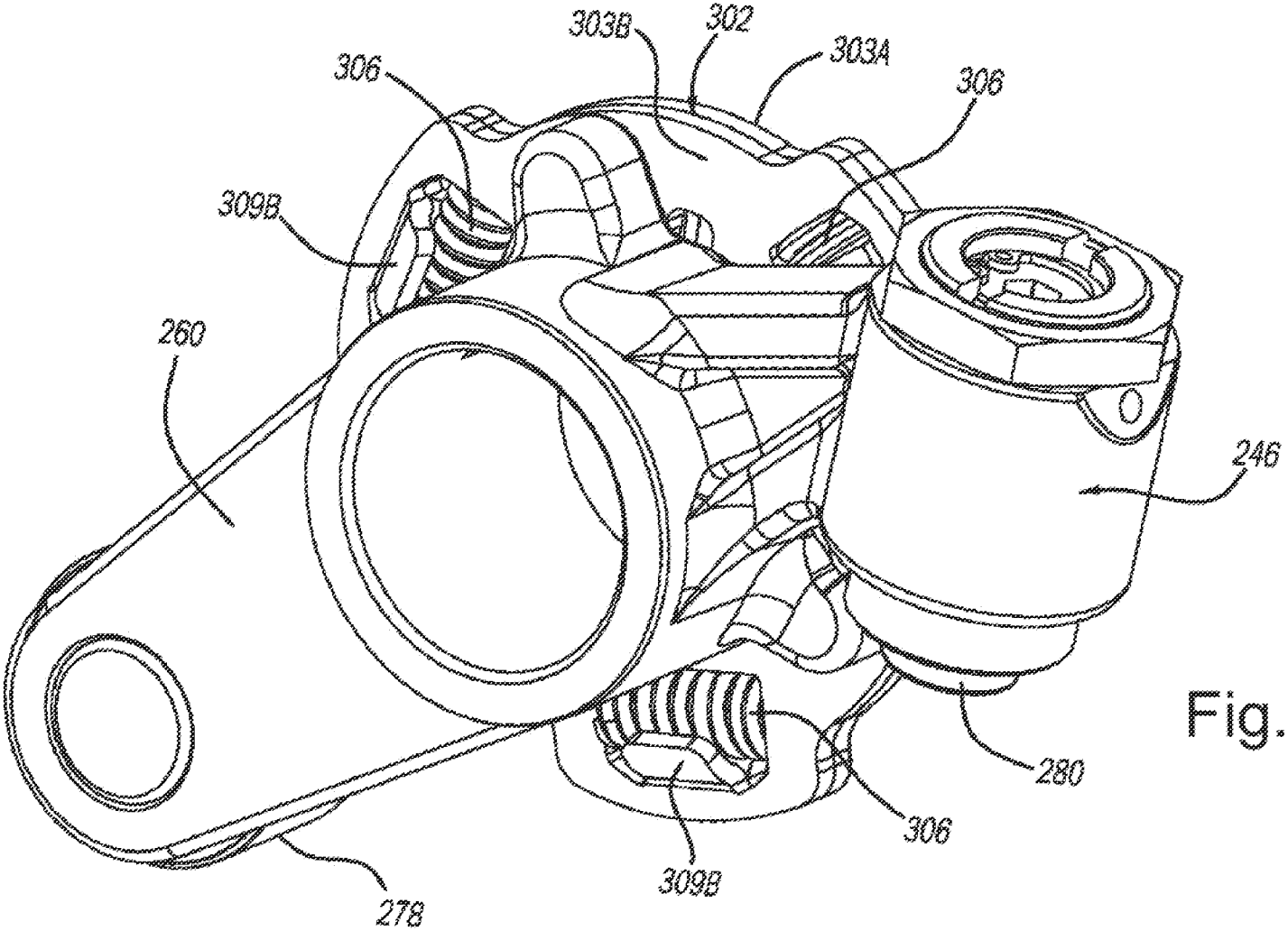
FIG. 16 is a second perspective view of the engine brake rocker arm and associated biasing assembly of FIG. 15.
Figure 17:
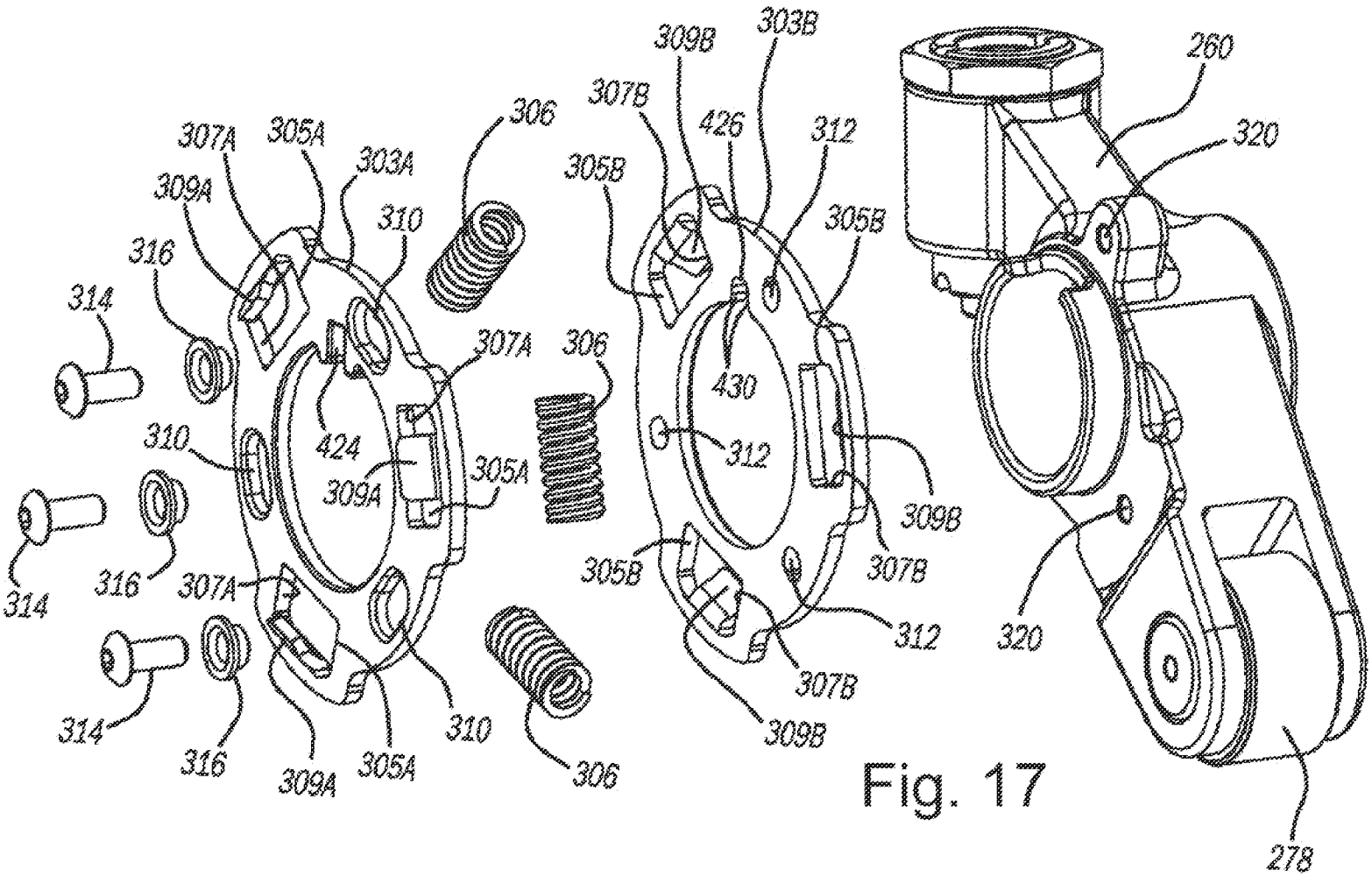
FIG. 17 is an exploded perspective view of the engine brake rocker arm and associated biasing assembly of FIG. 16.

With additional reference now to FIGS. 15-17, the engine brake rocker arm 260 includes an engine brake capsule 246. In general, the engine brake capsule 246 has a plunger 280 that is movably disposed in a cylinder 282. In the example shown, the plunger 280 can include the engaging portion 262. The rocker shaft 234 defines an oil supply channel 284 (FIG. 13). An oil supply passage 286 is defined in the engine brake rocker arm 260. The cylinder 282 can be supplied with pressurized fluid causing the plunger 280 to extend or to retract.

The engine brake rocker arm assembly 224 includes a biasing assembly 300 that cooperates with the engine brake rocker arm 260 to bias the engine brake rocker arm 260 to accommodate mechanical lash. As discussed herein, the biasing assembly 300 biases the engine brake rocker arm 260 to a neutral position out of contact with either the engine brake cam 274 or the valve 252. Moreover, the biasing assembly 300 can be attached to the engine brake rocker arm 260 and installed as a single assembly.

In the example embodiment, the biasing assembly 300 is a spring plate lost motion system that generally includes a spring plate assembly 302 collectively defined in part by first and second spring plates 303A, 303B. The spring plate assembly 302 defines a plurality of windows 304 collectively defined by respective first and second windows 305A, 305B. Each window 304 is configured to receive a biasing member 306 (e.g., a spring). Each or the first windows 305A are partially defined by a first spring bearing surface 307A. Each of the second windows 305B are partially defined by a second spring bearing surface 307B. A plurality of spring retainers 308 (FIG. 18), collectively defined by first fingers 309A (FIG. 17) formed on the first plate 303A and second fingers 309B formed on the second plate 303B are configured to retain the biasing members 306 within the windows 304.

The first plate 303A defines slots 310. The second plate 303B defines apertures 312. Fasteners 314 are configured to pass through respective grommets 316, slots 310, and apertures 312 and threadably secure into respective threaded bores 320 defined in the engine brake rocker arm 260. The second plate 303B is fixed for rotation with the engine brake rocker arm 260. The first plate 303A is fixed to the rocker shaft 234. As will be described herein, when the engine brake rocker arm 260 is caused to rotate around the rocker shaft 234, the biasing members 306 selectively compress and retract.

Figure 18:
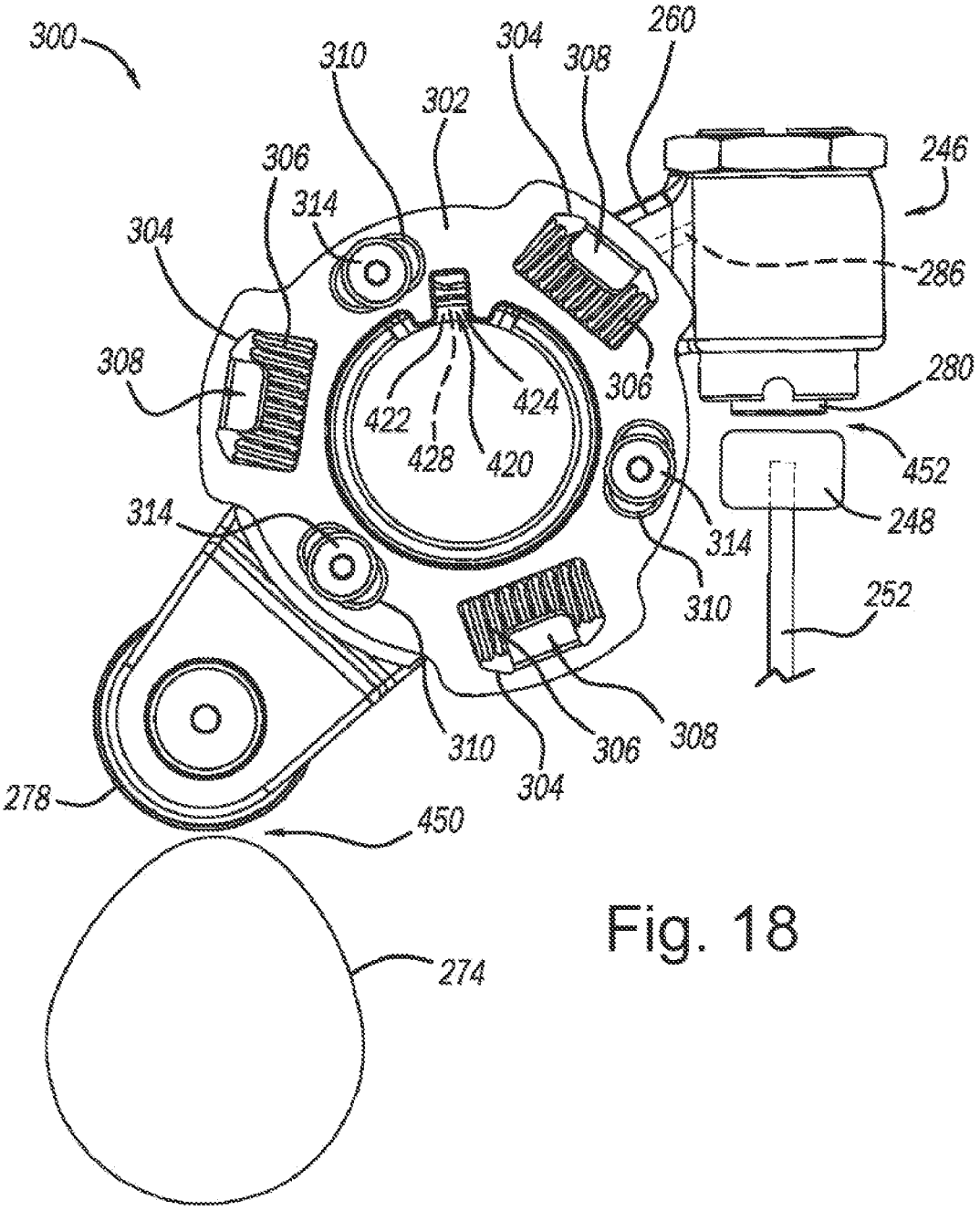
FIG. 18 is a front view of the engine brake rocker arm and biasing assembly of FIG. 15 and shown in a neutral position.
Figure 19:
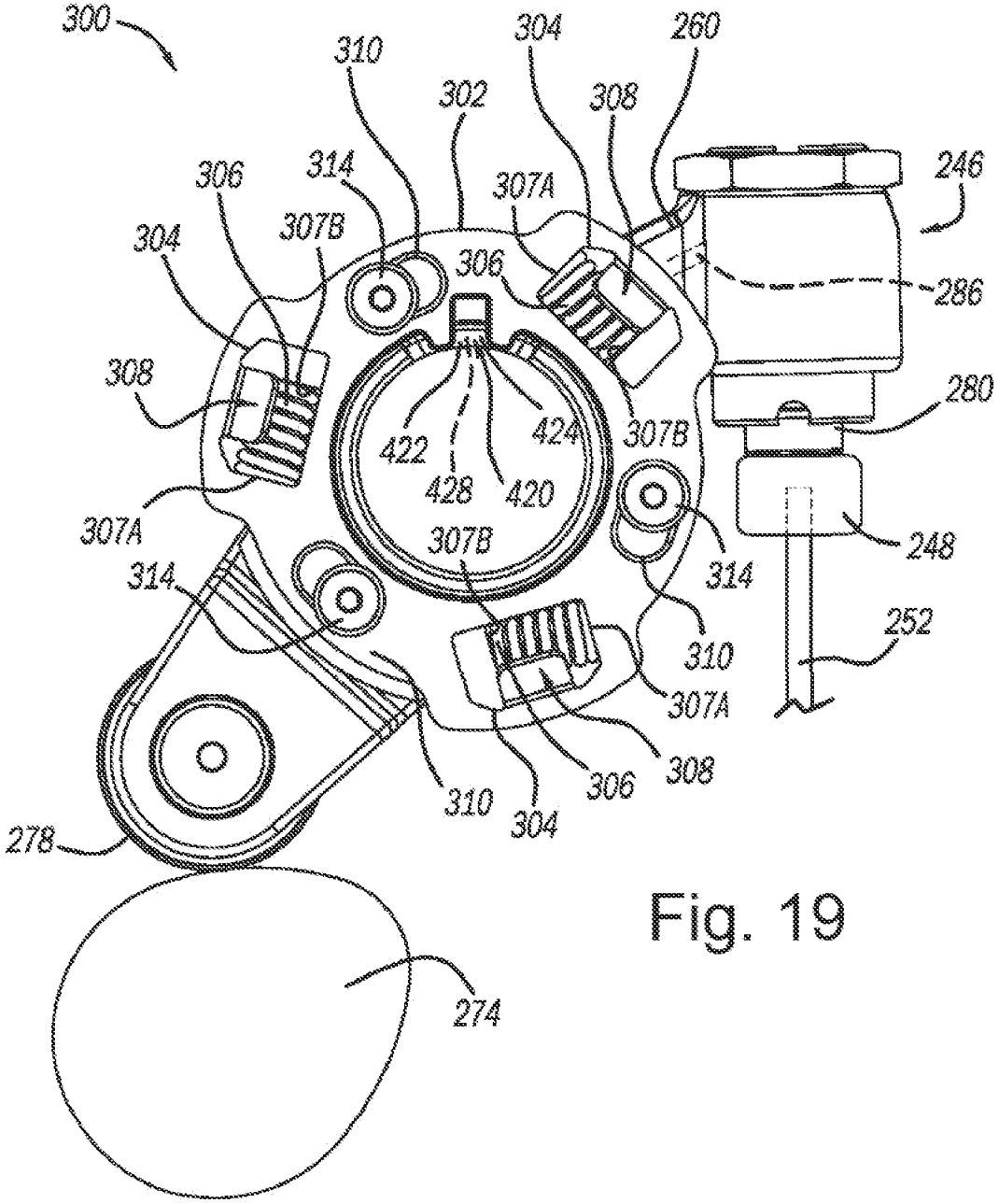
FIG. 19 is a front view of the engine brake rocker arm and biasing assembly of FIG. 15 and shown during an engine braking event wherein biasing members of the biasing assembly are loaded as the rocker arm rotates toward engagement with the engine brake cam lobe.
Figure 20:
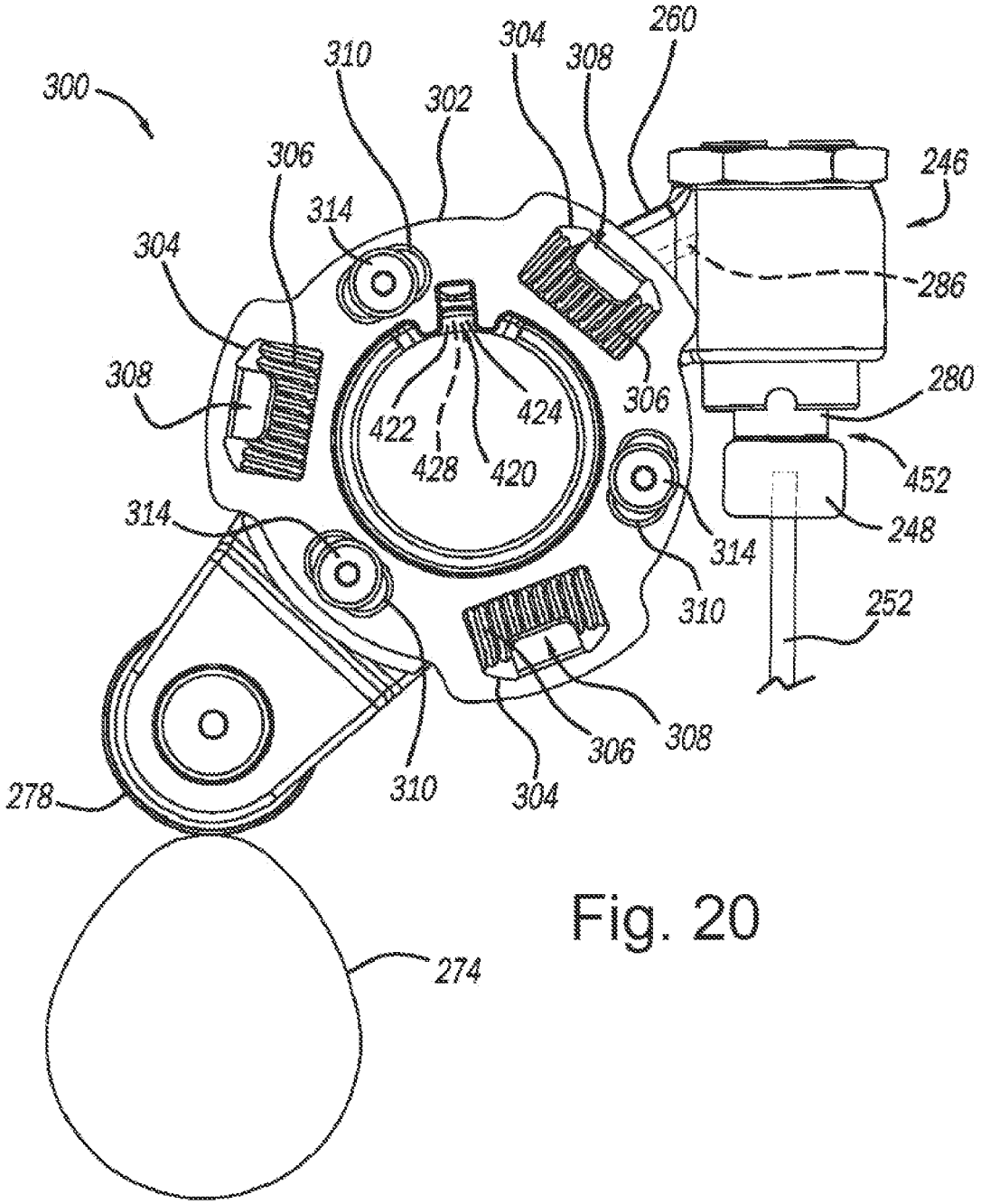
FIG. 20 is a front view of the engine brake rocker arm and biasing assembly of FIG. 19 and shown as the valve goes through a valve lift event and the biasing members become unloaded as the rocker arm rotates clockwise from the position shown in FIG. 19 to the position shown in FIG. 20.

With reference to FIGS. 18-20, an orientation system 420 cooperates with the biasing assembly 300 to hold the engine brake rocker arm 260 neutral in a desired rotational orientation. In the example embodiment, the orientation system 420 includes a key 422, a keyway 424 (FIG. 17) defined on the first plate 303A, and a rotational limitation slot 426 defined on the second plate 303B. As will become appreciated, the orientation system 420 fixes the engine brake rocker arm 360 to the first spring plate 303A.

The key 422 can be coupled to the rocker shaft 234 by inserting a portion of the key 422 into a slot or opening 428 formed in the rocker shaft 234. In some examples, the key 422 is press fit into slot 428 or has a tight clearance fit with the slot 428. In the example illustration, key 422 is a generally semi-circular disc. At least a portion of the key 422 extends outwardly from the outer surface of the rocker shaft 234 when inserted therein. Engine brake rocker arm 260 is configured to receive the rocker shaft 234 such that key 422 is at least partially disposed within the keyway 424 and the rotational limitation slot 426. The key 422 can be configured differently. For example, the key 422 can take other geometrical forms such as, but not limited to, a post that can be press-fit into a complementary bore defined in the rocker shaft 234. Other mechanical features can be incorporated as part of or as a supplemental attachment to the rocker shaft 234 to couple the first spring plate 303A in a fixed orientation relative to the rocker shaft 234. The key 422 fixes the first plate 303A relative to the rocker shaft 234.

The rotation limitation slot 426 is defined by a pair of opposed stops 430 which are each configured to engage the key 422 to limit the rotational travel of the engine brake rocker arm 260. The rotational limitation slot 426 is defined to provide full design rotation of the rocker arm 260 without the rocker arm 260 contacting the key 422. As such, during operation, the rocker arm shaft 234 and key 422 remain stationary while the engine brake rocker arm 260 selectively rotates about the rocker arm shaft 234. The stops 430, are positioned to engage key 422 and thus limit rotation of rocker arm 260 and facilitate maintaining the rocker arm 260 in a neutral position.

As mentioned above, the first spring plate 303A remains fixed relative to the rocker shaft 234. When the brake capsule 246 is "off" or collapsed, the engine brake rocker arm 260 returns to the neutral position such that the roller 278 is held off the engine brake cam lobe 274. See FIG. 18. Concurrently, the plunger 280 of the brake capsule 246 is held off of the lever 248. In this regard, when the brake capsule 246 is "off" and engine braking is not performed, the engine brake rocker arm 260 is encouraged to return this neutral position by the biasing assembly 300 whereby the roller 278 does not engage the engine brake cam lobe 274 on one side and the plunger 280 of the brake capsule 246 does not engage the lever 248 on an opposite side.

The neutral position as described herein is used to denote a first non-contact space 450 (FIG. 18) between the engine brake rocker arm 260 and the engine brake cam lobe 274 and a second non-contact space 452 between the engine brake rocker arm 260 and the valve 252. It is appreciated that the first non-contact space 450 is shown in FIG. 18 specifically between the roller 278 and the engine brake cam lobe 274. However, the first non-contact space 450 can be defined between any adjacent components intermediate the engine brake rocker arm 260 and the engine brake cam lobe 274. Similarly, while the second non-contact space 452 is shown in FIG. 18 specifically between the lever 248 and the plunger 280, the second non-contact space 252 can be defined between any adjacent components intermediate the engine brake rocker arm 260 and the valve 252.

During operation, the biasing members 306 hold the engine brake rocker arm 260 in a position relative to the spring plate assembly 302. When the engine brake capsule 246 extends, such as during an engine braking event (FIG. 19), the engine brake rocker arm 260 is caused to rotate in a direction toward the cam (counterclockwise as viewed from FIG. 18 to FIG. 19). The fasteners 314 and grommets 316 travel along the respective slots 310 of the first spring plate 303A. Concurrently, the second spring plate 303B is fixed for rotation with the engine brake rocker arm 260. The biasing members 306 become pre-loaded bearing against respective first and second spring bearing surfaces 307A, 307B. As the valve 252 goes through a valve lift event, the biasing members 306 become unloaded as the engine brake rocker arm rotates (clockwise from FIG. 19 to FIG. 20). The configuration described herein with respect to the biasing assembly 300 is configured to operate opposite to other prior art configurations that rely on valve lift to cause pre-loading of a biasing mechanism.

It should be understood that the mixing and matching of features, elements, methodologies and/or functions between various examples may be expressly contemplated herein so that one skilled in the art would appreciate from the present teachings that features, elements and/or functions of one example may be incorporated into another example as appropriate, unless described otherwise above.

What is claimed is:

1. A rocker arm assembly operable in a first mode and a second mode, the rocker arm assembly selectively opening first and second engine valves based on rotation of a cam shaft having a first cam lobe and a second cam lobe, the rocker arm assembly comprising:

a rocker shaft;

a first rocker arm assembly having a first rocker arm that receives the rocker shaft and is configured to rotate around the rocker shaft in the first mode based on engagement with the first cam lobe;

a second rocker arm assembly having a second rocker arm that receives the rocker shaft and is configured to rotate around the rocker shaft and selectively act on one of the first and second engine valves in the second mode based on selective engagement with the second cam lobe; and a biasing assembly that cooperates with the second rocker arm to bias the second rocker arm to a neutral position, wherein in the neutral position, the second rocker arm is spaced from contact relative to both of the second cam lobe and the second engine valve, wherein the biasing assembly further includes a spring plate assembly comprising:

a first spring plate fixed relative to the rocker shaft;

a second spring plate fixed for rotation with the second rocker arm; and at least one biasing member disposed relative to the first and second spring plates and configured to load and unload based on rotation of the second rocker arm around the rocker shaft.

2. The rocker arm assembly of claim 1 wherein the spring plate assembly defines at least one window that is configured to receive the at least one biasing member.

3. The rocker arm assembly of claim 2 wherein the at least one window is defined in part by a first bearing surface on the first spring plate and a second bearing surface on the second spring plate, wherein the at least one biasing member bears against the respective first and second bearing surfaces during rotation of the second rocker arm around the rocker shaft.

4. The rocker arm assembly of claim 2 wherein the spring plate assembly comprises at least one spring retainer configured to retain the at least one biasing member within the at least one window.

5. The rocker arm assembly of claim 1 wherein the first spring plate defines at least one slot and the second spring plate defines at least one aperture, wherein a fastener extends through the at least one slot and the at least one aperture and is threadably secured into a threaded bore defined in the second rocker arm, wherein the second spring plate rotates relative to the first spring plate while the fastener travels along the at least one slot during rotation of the second rocker arm during operation in the second mode.

6. The rocker arm assembly of claim 1 wherein the second rocker arm includes a capsule configured to move between a retracted position and an extended position, wherein in the retracted position, the biasing assembly biases the second rocker arm to the neutral position.

7. The rocker arm assembly of claim 6 wherein in the extended position, the second rocker arm is caused to rotate toward the second cam lobe preloading the biasing assembly.

8. The rocker arm assembly of claim 1, further comprising an orientation system having a key extending from the camshaft, a keyway defined on the first spring plate and a pair of opposed stops that define a rotational limitation slot on the second spring plate, wherein the key is fixed to the first spring plate at the keyway, and rotation of the second rocker arm is limited by engagement of the key with the pair of opposed stops on the second spring plate.

9. The rocker arm assembly of claim 1 wherein the first rocker arm assembly is an exhaust valve rocker arm assembly and the second rocker arm assembly is an engine brake rocker arm assembly.

10. The rocker arm assembly of claim 9 wherein the exhaust valve rocker arm assembly includes an exhaust rocker arm and a valve bridge, the valve bridge having a lever pivotally coupled thereto such that during operation in the second mode, the engine brake rocker arm assembly does not transfer motion to the valve bridge.

11. The rocker arm assembly of claim 1 wherein the first and second engine valves are exhaust valves and one of the first and second modes includes early exhaust valve opening (EEVO).

12. The rocker arm assembly of claim 1 wherein the first and second engine valves are intake valves and wherein one of the first and second modes includes late intake valve closing (LIVC).

13. A rocker arm assembly operable in a first mode and a second mode, the rocker arm assembly selectively opening first and second engine valves based on rotation of a cam shaft having a first cam lobe and a second cam lobe, the rocker arm assembly comprising:

a rocker shaft;

a first exhaust rocker arm that is configured to rotate around the rocker shaft based on engagement with the first cam lobe in the first mode;

a second engine brake rocker arm that is configured to rotate around the rocker shaft and selectively act on one of the first and second engine valves based on selective engagement with the second cam lobe in the second mode a capsule arranged on the second engine brake rocker arm and configured to move between an extended position and a retracted position; and a spring plate assembly that cooperates with the second engine brake rocker arm to bias the second engine brake rocker arm to a neutral position when the capsule is in the retracted position, wherein in the neutral position, the second engine brake rocker arm is spaced from contact relative to both of the second cam lobe and the second engine valve, the spring plate assembly comprising:

a first spring plate fixed relative to the rocker shaft;

a second spring plate fixed for rotation with the second engine brake rocker arm; and at least one biasing member that selectively biases against the first and second spring plates upon rotation of the second engine brake rocker arm.

14. The rocker arm assembly of claim 13 wherein the spring plate assembly defines at least one window that is configured to receive the at least one biasing member.

15. The rocker arm assembly of claim 14 wherein the at least one window is defined in part by a first bearing surface on the first spring plate and a second bearing surface on the second spring plate, wherein the at least one biasing member bears against the respective first and second bearing surfaces during rotation of the second rocker arm around the rocker shaft.

16. The rocker arm assembly of claim 15 wherein the spring plate assembly comprises at least one spring retainer configured to retain the at least one biasing member within the at least one window.

17. The rocker arm assembly of claim 13 wherein the first plate defines at least one slot and the second spring plate defines at least one aperture, wherein a fastener extends through the at least one slot and the at least one aperture and is threadably secured into a threaded bore defined in the second rocker arm, wherein the second spring plate rotates relative to the first spring plate while the fastener travels along the at least one slot during rotation of the second rocker arm during operation in the second mode.

18. The rocker arm assembly of claim 13 wherein in the extended position, the second rocker arm is caused to rotate toward the second cam lobe preloading the at least one biasing member.

19. The rocker arm assembly of claim 13, further comprising an orientation system having a key extending from the camshaft, a keyway defined on the first spring plate and a pair of opposed stops that define a rotational limitation slot on the second spring plate, wherein the key is fixed to the first plate at the keyway, and rotation of the second rocker arm is limited by engagement of the key with the pair of opposed stops on the second plate.

* * * * *